United States Patent [19]

Lamb et al.

[11] Patent Number: 4,582,221

[45] Date of Patent: Apr. 15, 1986

[54] REFRIGERATED STORAGE TANK ROOF CONNECTION

[75] Inventors: LeGrand R. Lamb, Glen Ellyn; David Fletcher, Downers Grove; George A. Baker, Batavia, all of Ill.

[73] Assignee: Chicago Bridge & Iron Company, Oak Brook, Ill.

[21] Appl. No.: 598,493

[22] Filed: Apr. 9, 1984

[51] Int. Cl.[4] ..... B65D 90/06

[52] U.S. Cl. ..... 220/465; 220/421; 220/901

[58] Field of Search ..... 220/465, 421, 429, 367, 220/215, 901, 85 F, 444, 446, 447

[56] References Cited

U.S. PATENT DOCUMENTS

| | | | |
|---|---|---|---|
| 3,272,579 | 9/1966 | Leonard | 220/421 X |
| 3,446,387 | 5/1969 | Webb | 220/465 X |
| 3,666,132 | 5/1972 | Yamamoto et al. | 220/901 X |
| 4,461,399 | 7/1984 | Sattelberg et al. | 220/465 X |

*Primary Examiner*—Steven M. Pollard

*Attorney, Agent, or Firm*—Marshall, O'Toole, Gerstein, Murray & Bicknell

[57] ABSTRACT

In a storage tank having at least a fixed exterior roof through which a pipe connection extends for feeding or removing a fluid from the tank, the improvement comprising a pipe connection including a pipe extending through an oversized hole in the roof; a sleeve, surrounding but spaced outwardly from the pipe, extending through the roof hole and connected to the roof around the hole; the sleeve having an upper end spaced upwardly above the roof and connected to the pipe; the sleeve having a lower end spaced below the roof and unattached to the pipe; granular insulation occupying the space between the sleeve and the pipe; and a barrier preventing the granular insulation from flowing out the sleeve lower end.

1 Claim, 7 Drawing Figures

FIG. 1
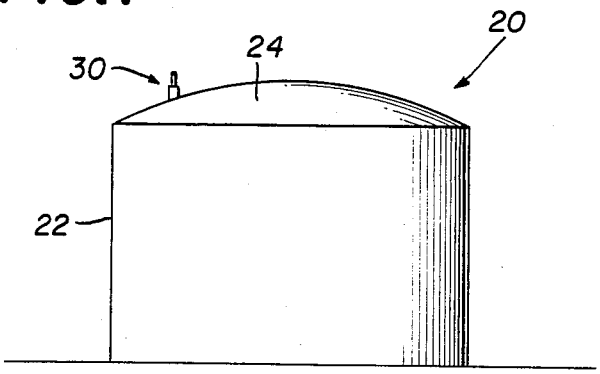
FIG. 4
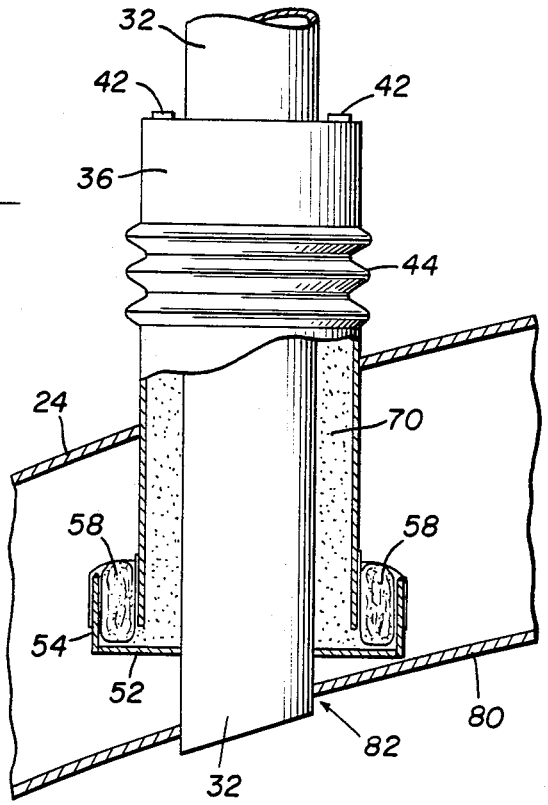
FIG. 2
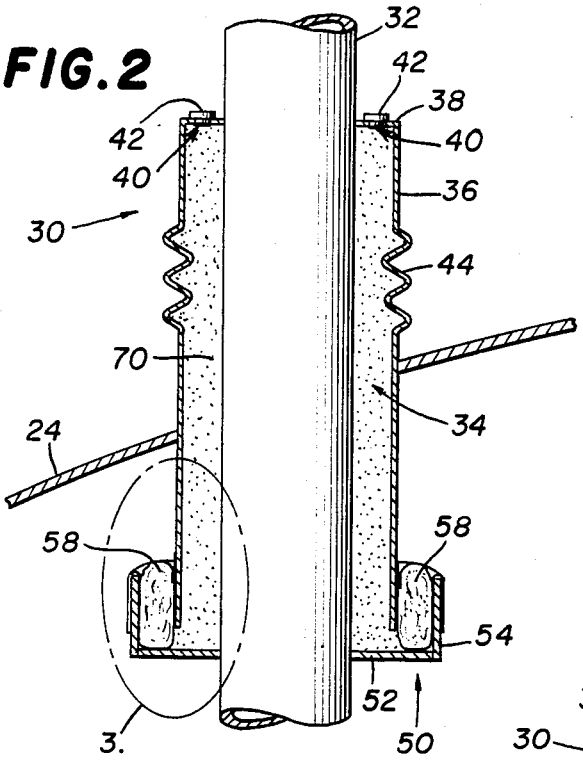
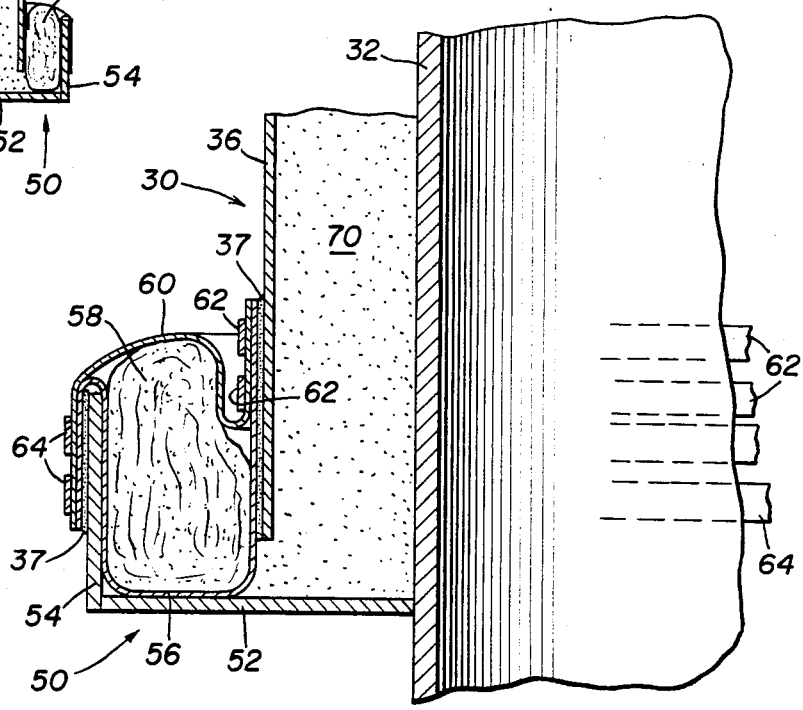
FIG. 3

REFRIGERATED STORAGE TANK ROOF CONNECTION

This invention relates to storage tanks for liquids and gases. More particularly, this invention is concerned with an improved pipe connection for a storage tank in which a fluid substantially above or below atmospheric temperature is fed into or removed from the tank through a pipe which penetrates the tank roof.

BACKGROUND OF THE INVENTION

Liquids and gases have been stored in tanks for many years. When the liquid or gas is to be stored in the tank at a temperature substantially above or below ambient or atmospheric temperature, it is often necessary or at least highly desirable for tank penetrations to be located above the intended maximum stored product level so as to maintain structural integrity of the tank bottom and wall for safety reasons.

The configuration of pipe connections for carrying hot or cold fluids in or out through the roof of a tank is an important consideration. As a result, there is substantial variation in arrangements, sometimes due to roof configuration and whether the pipe terminates at the roof line, extends some distance inside the tank, or connects rigidly to an inner tank roof if one is present. In addition to the forces caused by the weight of the connection structural components, and the weight and dynamics of the flowing product, the design must consider the movement of the structural components due to temperature change. Also, when a large double walled tank is involved, for economic reasons the outer tank, outside of the boundaries of the tank insulation, is often made of material which is not resistant to the low or high temperature of the product. As a result, it is necessary to protect the tank roof from the temperature of the product.

In one type of roof connection an expansion bellows is incorporated in the transition between the hot or cold pipe and an ambient temperature outer roof. The function of the connection is to provide a continuous seal while permitting the required movement and yet maintain the intended temperature differential between the pipe and the roof. To maintain the temperature differential, it is necessary to add insulation between the bellows assembly and the pipe. The insulation has traditionally been installed from inside the tank roof before the tank goes into service. The insulation most commonly used has been a glass fiber blanket wrapped around the pipe and slid into the gap. To reduce convection and fill the space, the blanket is precompressed or packed into the space.

Problems have been encountered installing the insulation system on large pipe and connection sizes. As pipe sizes increased, visibility in the space decreased, reaching into the space became impossible and the force required to slide the insulation into place increased to the point where hand work became ineffective. If the insulation was not sufficiently precompressed and fastened during installation there was danger of it sliding down the pipe. In a tank for storing a cryogenic liquid, if voids were left in the insulation, frost or ice might appear on the outside of the bellows or distance piece or sleeve assembly adjacent to the voids. Whenever any problem of this type did appear, it was very difficult to make repairs because of lack of access.

From the above discussion it is believed clear that a need exists for alternative means of insulating a roof connection to a tank.

SUMMARY OF THE INVENTION

According to the invention an improved storage tank having at least a fixed exterior roof through which a pipe connection extends for feeding or removing a fluid from the tank is provided. The fluid can be a liquid or a gas. The improvement comprises a pipe connection including a pipe extending through an oversized hole in the roof; a sleeve, surrounding but spaced outwardly from the pipe, extending through the roof hole and connected to the roof around the hole; the sleeve having an upper end spaced upwardly above the roof and connected to the pipe; the sleeve having a lower end spaced below the roof and unattached to the pipe; granular insulation occupying the space between the sleeve and the pipe; and barrier means preventing the granular insulation from flowing out the sleeve lower end.

To prevent the granular insulation from flowing out the sleeve lower end a barrier comprising compressed filler material can be positioned between the pipe and sleeve adjacent the sleeve lower end, with a retainer included to keep the filler material from sliding out of the sleeve. Alternatively, the granular insulation can be kept from flowing out the sleeve lower end by a barrier comprising a tray positioned to surround the pipe beneath the lower end of the sleeve. The tray can be joined to the pipe.

The tray can have a circular bottom with an upright flange along the periphery of the tray bottom. The flange can extend vertically upward from the tray edge and be located or spaced radially outward from the sleeve and terminate above the sleeve lower end. Means, such as a compressed filler material, can be positioned between the flange and the sleeve to prevent granular insulation from flowing out of the space between the sleeve and the pipe. A sheet of fabric can be placed over the compressed filler material and be joined to the flange and the sleeve to cover the area therebetween as further assurance against escape of the compressed filler material and to act as a secondary seal.

The sleeve desirably contains at least one closeable port, above the roof, through which granular insulation can be fed to the space between the sleeve and pipe. The port can be located near the top of the sleeve.

In most cases the sleeve is provided with a means, such as a bellows, between the top of the roof and where the sleeve is joined to the pipe, which permits the sleeve to longitudinally, and sometimes radially, expand and contract with temperature change.

Although the tank has at least an outer roof, it can have an inner roof as well. When an inner roof is present, the lower end of the sleeve can be between the two roofs. The pipe can extend through a hole in the inner roof and be connected to the inner roof around the hole.

BRIEF DESCRIPTION OF THE DRAWINGS

FIG. 1 is an elevational view of a storage tank containing an improved roof pipe connection according to the invention;

FIG. 2 is an enlarged view, partially in section, of the pipe connection shown in FIG. 1;

FIG. 3 is a sectional view of the lower part of the pipe connection shown in FIG. 2;

FIG. 4 is similar to FIG. 2 but shows a pipe connection on a tank having both inner and outer roofs;

DETAILED DESCRIPTION OF THE DRAWINGS

Figure 5:
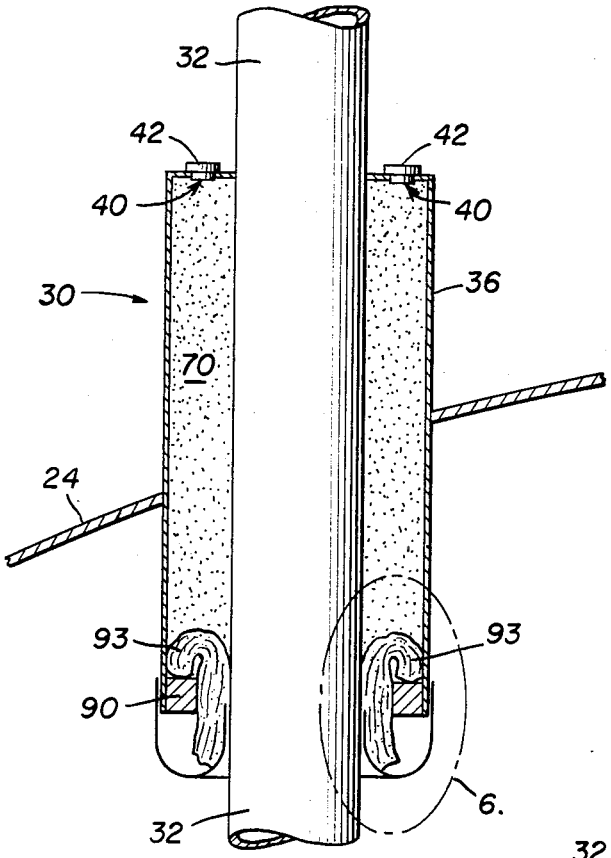
FIG. 5 is an elevational view, partially in section, of a second embodiment of pipe connection according to the invention.

To the extent it is reasonable and practical, the same elements or parts which appear in the various views of the drawings will be identified by the same numbers.

The storage tank 20 shown in FIG. 1 has a flat metal bottom (not shown), a vertical cylindrical circular wall 22 and a single domed roof 24. While a domed roof is shown, the roof can be some other shape, such as a conical roof. The tank 20 is intended to store a hot or cold fluid at a temperature substantially above or below ambient or atmospheric temperature. Accordingly, the tank can be insulated as required for the intended use.

Pipe connection 30 penetrates roof 24 of tank 20. Pipe 32, vertically positioned, extends through an oversized hole 34 in roof 24. Sleeve 36 surrounds pipe 32 in the area above and below where the pipe penetrates roof 24. Sleeve 36 is fixedly joined to the edge of hole 34. Sleeve 36 has an inwardly directed horizontal flange or ring 38 on its upper end which is fixedly joined to pipe 32. One or more ports or holes 40 are provided in flange 38 for feeding granular insulation 70, such as perlite, into the sleeve. Removable plugs 42 are placed in the ports 40 to prevent water from entering the sleeve and to restrict convection currents.

A bellows 44, if desired, can be included in sleeve 36 above roof 24 so that the sleeve can expand and contract with vertical movement of pipe 32 induced by temperature change.

The lower end of sleeve 36 terminates in a tray 50 which has a horizontal bottom 52, in the form of a ring, attached to pipe 32. Vertical circular flange 54 extends upwardly from, and is joined to, the outer edge of flange 52.

A glass fiber cloth or fabric 56 is positioned in the space between the lower end of sleeve 36 and vertical flange 54. A compressed pad or blanket 58 of glass fiber is placed in the pocket defined by fabric 56. Glass cloth or fabric 60 is placed over the blanket 58. The inner ends or edges of fabrics 56 and 60 are positioned in overlapping position adjacent sleeve 36 with a layer of adhesive 37 between the fabric and the sleeve. Bands 62 are then positioned on the assembly of fabric layers and wrapped completely around the sleeve 36. Similarly, the outer edges of the fabrics 56 and 60 are draped over the edge of flange 54, with an adhesive 37 on the outer edge of that flange. The composite fabric assembly is then secured to vertical flange 54 by bands 64.

After the blanket 58 is secured in place the granular insulation 70 is fed into the space between the sleeve 36 and pipe 32. The granular insulation is kept from flowing out the bottom of the sleeve by flange 54, under static conditions. However, since thermal movement could push the granular insulation over the flange, the blanket 58 is provided. The granular insulation is introduced into the sleeve through ports 40, with one or more of plugs 42 temporarily removed. Once the sleeve has been filled the plugs are repositioned in the ports.

The granular insulation can be installed using a forced gas blower pot or a continuous flow eductor. Air is adequate before the tank is put in service or after service if the product is not dangerous. Once in service, nitrogen would be used if the stored product is flammable.

If it becomes necessary or desirable, after the tank has been in service, to add granular insulation to the sleeve interior, it is only necessary to remove plugs 42, add the granular insulation and then replace the plugs. The tank can be kept in service while this is done since no entry into the tank is necessary. Furthermore, all of the granular insulation can be removed through the ports 40 from inside the sleeve by vacuum means and fresh insulation added without entering the tank.

The permeability of the granular insulation is such that it eliminates the convection experienced when a low density glass fiber pad or blanket is used as the complete insulation in the sleeve. The low permeability also makes it possible to completely fill and compact the insulation into all the insulation space leaving no void and minimizing settlement. When the insulation supply is fed into the sleeve through one of the ports 40 with the other ports closed, the conveying gas escapes downward through the insulation already in place. The gas flow compacts the insulation as it enters the surface and flows through and out the bottom of the granular insulation.

FIG. 4 illustrates the pipe connection 30 just described in connection with FIGS. 1 to 3 in use on a tank having an outer roof 24 and an inner roof 80. Inner roof 80 contains a hole 82 through which the lower end of pipe 32 extends. The pipe 32 is joined to the periphery of hole 82. However, the described connection permits the roofs 24 and 80 to move vertically with respect to each other without any adverse effect on the connection.

Figure 6:
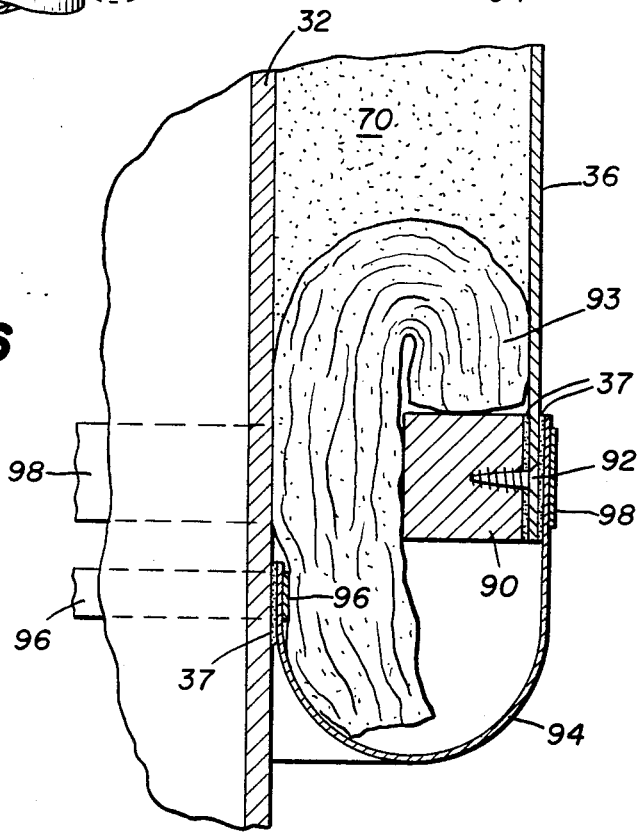
FIG. 6 is an enlarged view of the lower part of the pipe connection shown in FIG. 5.

FIGS. 5 and 6 illustrate another embodiment of the invention. However, this embodiment differs from those already described primarily in the way the granular insulation is prevented from escaping out of the lower end of the sleeve. However, the sleeve 36 in this embodiment contains no bellows.

With reference to FIGS. 5 and 6, a wooden restraining or stop ring 90 is secured in place on the lower end inner surface of sleeve 36 by placing an adhesive 37 between the ring and the sleeve and then mechanically binding the components together by screws 92. A pad or blanket of glass fibers 93 is then packed between pipe 32 and stop ring 90. The inner edge of glass fiber cloth or fabric 94 is bonded to pipe 32 by an adhesive 37 and then a band 96 is wrapped around the pipe over the fabric. The outer edge of fabric 94 is then bonded to the lower outer edge of sleeve 36 by adhesive 37 and a band 98 is subsequently wrapped around the sleeve 36 over the fabric 94. After the lower end of the sleeve is sealed off in this manner the sleeve interior can be filled with granular insulation 70 as already described above.

Figure 7:
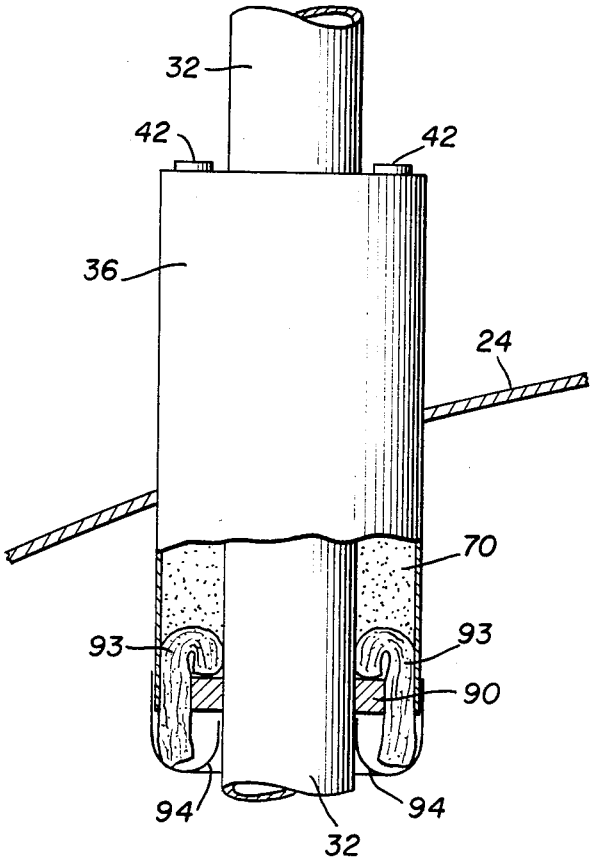
FIG. 7 is an elevational view, partially broken away and in section, of a pipe connection having a stop ring on the pipe instead of the sleeve as shown in FIGS. 5 and 6.

FIG. 7 illustrates a variation of the pipe connection shown in FIGS. 5 and 6. In the variation shown in FIG. 7, the restraining ring or stop 90 is bonded to the pipe 32 instead of to the sleeve 36. The blanket 93, furthermore, is between the ring 90 and sleeve 36 instead of between the pipe 32 and ring 90 as in FIGS. 5 and 6. In all other respects, the pipe connections of FIG. 7 on one hand, and FIGS. 5 and 6 on the other hand, are essentially alike.

The foregoing detailed description has been given for clearness of understanding only, and no unnecessary limitations should be understood therefrom, as modifications will be obvious to those skilled in the art.

What is claimed is:

1. In a storage tank having at least a fixed exterior roof through which a pipe connection extends for feeding or removing a fluid from the tank, the improvement comprising:

a pipe connection including a pipe extending through an oversized hole in the roof;

a sleeve, surrounding but spaced outwardly from the pipe, extending through the roof hole and connected to the roof around the hole;

the sleeve having an upper end spaced upwardly above the roof and connected to the pipe;

the sleeve having a lower end spaced below the roof and unattached to the pipe;

granular insulation occupying the space between the sleeve and the pipe;

a tray surrounding and joined to the pipe beneath the lower end of the sleeve for preventing the granular insulation from flowing out the sleeve lower end;

the tray having a circular bottom with an upright flange along the periphery of the tray bottom with the flange entending upwardly from the tray bottom and positioned radially outwardly from the sleve and terminating above the sleeve lower end;

a compressed filler material positioned between the flange and the sleeve to prevent granular insulation from flowing out of the space between the sleeve and the pipe; and a sheet of fabric placed over the compressed filler material and joined to the flange and the sleeve to cover the area therebetween and to act as a secondary seal and/or means to prevent loss of the compressed material.

* * * * *